US006196397B1

(12) United States Patent
Maher

(10) Patent No.: US 6,196,397 B1
(45) **Date of Patent: *Mar. 6, 2001**

(54) RACK FOR HOLDING A GLIDING BOARD

(75) Inventor: Liam Maher, Bristol, VT (US)

(73) Assignee: Burton Corporation, Burlington, VT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/003,258

(22) Filed: Jan. 6, 1998

(51) Int. Cl.[7] ..... A47F 7/00; A47F 5/08
(52) U.S. Cl. ..... 211/85.7; 211/89.01; 211/70.5
(58) Field of Search ..... 211/85.7, 89.01, 211/70.5; D6/552; 248/316.2

(56) References Cited

U.S. PATENT DOCUMENTS

| | | | | |
|---|---|---|---|---|
| D. 248,347 | * | 7/1978 | McCollum | D6/125 |
| D. 308,996 | * | 7/1990 | Katz | D21/229 |
| D. 344,868 | * | 3/1994 | Martinell | D6/552 |
| D. 386,236 | * | 11/1997 | Gervasoni | D21/229 |
| 1,210,934 | | 1/1917 | Hayes | 248/488 |
| 1,389,984 | * | 9/1921 | Reed | 211/89.01 X |
| 1,510,978 | | 10/1924 | Conklin | 248/304 |
| 1,608,651 | | 11/1926 | Farmer | 40/158.1 |
| 1,930,656 | | 10/1933 | Nave | 248/18 |
| 2,767,854 | * | 10/1956 | Barrett | 211/85.7 |
| 3,049,323 | | 8/1962 | Peterka | 248/28 |
| 3,245,645 | | 4/1966 | Dupler | 248/215 |
| 3,347,504 | | 10/1967 | Goss | 248/488 |
| 3,394,790 | | 7/1968 | Braun | 194/64 |
| 3,424,418 | | 1/1969 | Freedman et al. | 248/216 |
| 3,586,355 | | 6/1971 | Magi | 287/14 |
| 3,756,420 | * | 9/1973 | Brown | 211/4 X |
| 4,312,467 | | 1/1982 | Kulwin | 224/315 |
| 4,345,732 | | 8/1982 | Gallegos | 248/441 B |
| 4,391,376 | * | 7/1983 | Finnegan | 211/70.5 |
| 4,438,878 | | 3/1984 | Heslop | 224/319 |
| 4,779,180 | | 10/1988 | Ruiz | 362/433 |
| 4,786,025 | | 11/1988 | Shuman | 248/558 |
| 5,120,012 | * | 6/1992 | Rosenau | 211/89.01 X |
| 5,139,221 | * | 8/1992 | Lodrick | 211/68 X |
| 5,183,316 | | 2/1993 | Heinzle | 211/70.5 |
| 5,371,994 | | 12/1994 | Waters | 52/749 |
| 5,390,837 | | 2/1995 | Ruffolo, Jr. | 224/42.45 R |
| 5,417,335 | * | 5/1995 | White | 211/89.01 X |
| 5,477,968 | * | 12/1995 | Largent et al. | 211/70.5 X |
| 5,551,728 | * | 9/1996 | Barthel et al. | 280/14.1 X |
| 5,601,196 | * | 2/1997 | Heer et al. | 211/89.01 X |
| 5,782,704 | * | 7/1998 | Tetler et al. | 211/70.2 X |
| 5,788,133 | * | 8/1998 | Mareno | 211/70.5 X |
| 5,799,915 | | 9/1998 | Morey | 248/201 |

FOREIGN PATENT DOCUMENTS

| | | | |
|---|---|---|---|
| 619 125 | 9/1980 | (CH) . | |
| 1 455 162 | 11/1976 | (GB) | 248/488 |
| 4-115471 | 10/1992 | (JP) . | |

* cited by examiner

*Primary Examiner*—Daniel P. Stodola
*Assistant Examiner*—Erica B. Harris
(74) *Attorney, Agent, or Firm*—Wolf, Greenfield & Sacks P.C.

(57) ABSTRACT

A rack designed to hold and/or display gliding boards, such as snowboards, without requiring adjustment of the rack and without causing damage to the board. The rack includes a base which mounts to a support structure, and further includes at least one pair of engagement members, with each engagement member including a side surface and a rear surface that grips the heel edge, toe edge, and top or bottom surface of the board to hold the board in place. The side surfaces may be cut at an acute angle such that the engagement member wraps slightly around the upper surface of the board to grip the board. The engagement members may be made of resilient, flexible material which facilitates gripping of the board, without damaging the board. The rack may also be configured to hold snowboards of various sizes.

36 Claims, 3 Drawing Sheets

RACK FOR HOLDING A GLIDING BOARD

DESCRIPTION

1. Technical Field

The present application relates to a rack designed to hold and/or display a gliding board and, more particularly, a snowboard.

2. Description of the Art

Specifically configured boards for gliding along a terrain are known, such as snowboards, snow skis, water skis, wake boards, surfboards and the like. For purposes of this patent, "gliding board" will refer generally to any of the foregoing boards as well as to other board-type devices which allow a rider to traverse a surface. For ease of understanding, however, and without limiting the scope of the invention, the rack for holding a gliding board to which this patent is addressed is disclosed below particularly in connection with a snowboard.

A snowboard includes a generally flat base with a lower surface that glides along the snow and an upper surface (or face) on which a snowboard rider stands. The snowboard further includes a tip, a tail, and opposed heel and toe edges. A width of the board typically tapers inwardly from both the tip and tail towards the central region (or waist) of the board, facilitating turn initiation and exit, and edge grip. The snowboard is often provided with graphics or other decorative or customized markings on the upper and lower surfaces of the board.

When a snowboard is not in use, the snowboard is typically stored by simply leaning the board against a wall, or laying the board flat on a shelf or on the ground. However, storing a snowboard in this manner can damage the top or bottom surfaces and side edges of the board. When displaying a board for sale or at a trade show, clamps are often used to hold the snowboard upright so that the graphics are visible. The board is placed between the clamps, which must then be manually tightened. Such clamps may grip the lower and upper surface of the board and may also contact the board edges. This arrangement however, may block or obscure portions of the graphic design on the face of the board.

SUMMARY

The present invention is a rack designed to hold and/or display gliding boards, such as snowboards, without requiring adjustment of the rack and without causing damage to the board. The rack includes a base which mounts to a wall, or other support structure, and further includes at least one pair of engagement members, each engagement member including a shoulder defined by a side surface and a rear surface that grips the heel edge, toe edge, and top or bottom surface of the board to hold the board in place. The side surface may be cut at an acute angle to ensure that the shoulder wraps slightly around the top surface of the board to grip the board. The engagement members may be made of resilient, flexible material which facilitates gripping of the board, without damaging the board.

In one embodiment, the rack is configured to hold snowboards of various sizes and includes a series of stepped engagement members of varying dimensions. For example, the rack may include seven pairs of stepped shoulders with the distance between the first shoulder and the second shoulder of the first pair being about 7.5 inches, and the distance between the first and second shoulders of the seventh pair being about 10.75 inches. The distances between the first and second shoulders of the remaining pairs range between about 7.5 to 10.75 inches, to accommodate snowboards sized within the range.

It is therefore an object of the present invention to provide a rack for holding one or more size snowboards without requiring adjustment of the rack.

It is another object of the present invention to provide a rack for holding one or more snowboards without damaging the top, bottom or side edges of the snowboard.

It is another object of the present invention to provide a rack for holding one or more snowboards which does not cover or block viewing of the graphics on the snowboard when inserted into the rack.

It is another object of the present invention to provide a rack which holds one or more snowboards in a secure manner, while simultaneously permitting easy removal of the snowboards from the rack.

BRIEF DESCRIPTION OF THE DRAWINGS

Various embodiments are described herein with reference to the drawings, wherein.

DETAILED DESCRIPTION OF THE EMBODIMENTS

Figure 1:
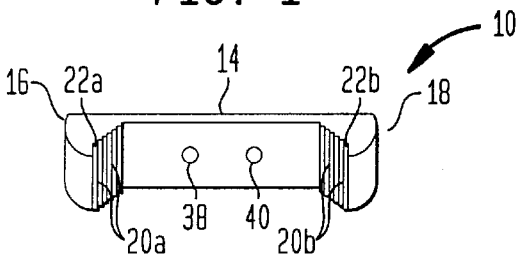
FIG. 1 is a front view of a rack for holding a board.

In one embodiment of the invention, shown in FIGS. 1–4, a rack 10 is provided for holding a gliding board, such as a snowboard 12. Rack 10 preferably includes a base or frame 14 for mounting the rack to a support surface, such as a wall, a first sidewall 16 extending from base 14 and a second sidewall 18 spaced from the first sidewall 16 and, likewise, extending from base 14. A pair of engagement members, designated generally as 20*a* and 20*b*, may be formed on inner surface 22*a*, 22*b* of sidewalls 16 and 18, respectively. Engagement members 20*a*, 20*b* are designed to grip a portion of the heel edge 24, toe edge 26 and top or bottom surface 28 of board 12, to hold the board in a substantially aligned position from the tip 30 to the tail 32 of the board. The engagement members may be made of resilient, flexible material such as extruded rubber, which facilitates gripping of the board, without damaging the board. Alternately, other materials may be utilized, provided that the material utilized should not scratch or damage the board. Rack may be mounted to hold snowboard 12 in any orientation; that is, the board may be stored or displayed in a substantially vertical, substantially horizontal, or in a tilted arrangement.

Figure 2:
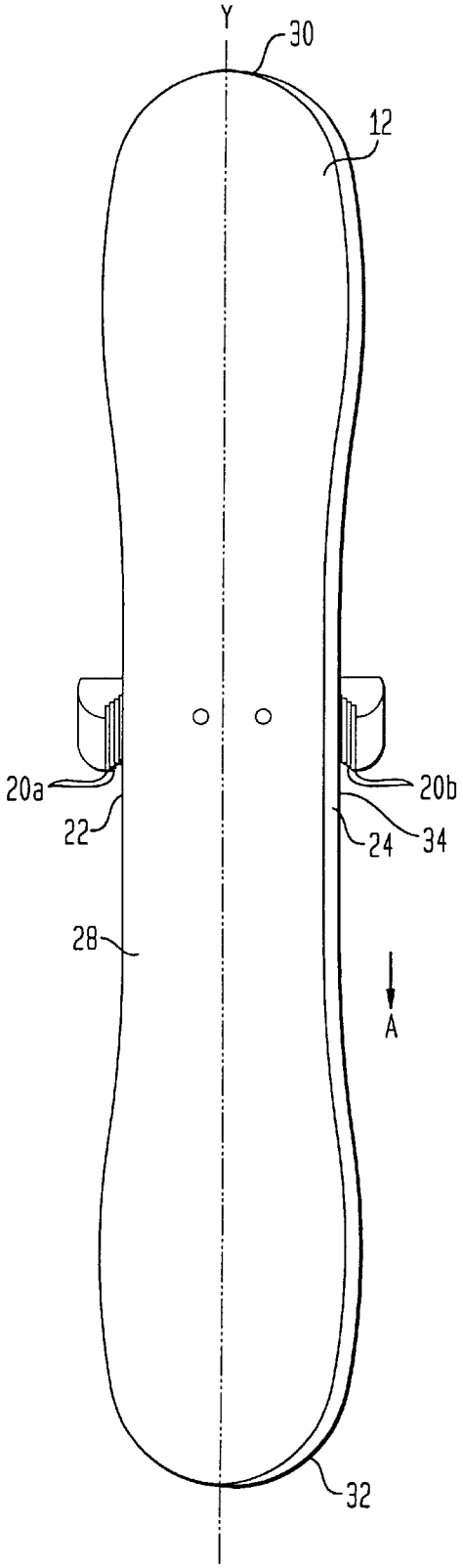
FIG. 2 is a front view of the rack of FIG. 1 holding a snowboard in a substantially vertical direction from tip to tail.
Figure 3:
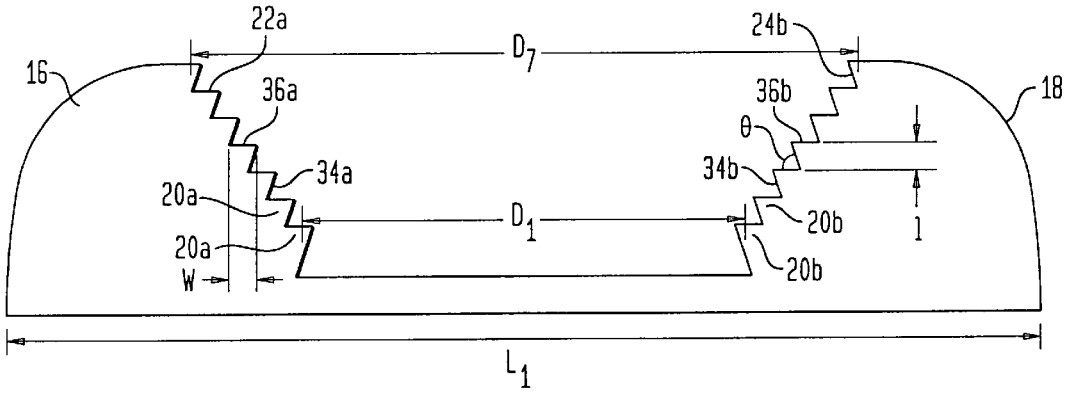
FIG. 3 is a schematic, side view of the rack of FIG. 1.

For the arrangement shown in FIG. 2, snowboard 12 may be inserted into rack 10 by placing the waist 34 of the board between engagement members 20*a*, 20*b* and sliding or lowering the board until the engagement members grip the board. Because the width of the snowboard tapers from both the tip and the tail end toward the waist of the board, the width of the board is narrowest at the waist and increases as the board is moved away from the waist, until the effective width of the board increases to a point where the engagement members grip the board. In the present embodiment, engagement members 20*a*, 20*b* may each be configured as a shoulder including a side surface 34*a*, 34*b* and a rear surface 36*a*, 36*b*, as shown in FIG. 3. Side surfaces 34*a*, 34*b* may preferably be cut into the inner surfaces 22*a,* 22*b* of sidewalls 16 and 18 at a slightly acute angle such that the rear surfaces 36*a,* 36*b* of the engagement members wrap slightly around a portion of the upper surface 28 of board 12 when the board is inserted into and held by rack 10. Engagement members 20*a,* 20*b* secure the board within rack 10 by engaging a portion of the heel and toe edges of snowboard 12 with side surfaces 34*a,* 34*b* and by also engaging a portion of the upper surface of the board with rear surfaces 36*a,* 36*b,* as shown in FIG. 2. In the present embodiment, rear surfaces 36*a,* 36*b* may each be about 0.4 inches wide, w, side surfaces 34*a,* 34*b* may each be about 0.5 inches long, l and may be cut at an angle θ of less than about 90 degrees, and base 14 may be about 17 inches long, $L_1$. Other dimensions may readily be utilized, as would be known to one of skill in the art.

The ends or side surfaces 34*a,* 34*b* of the engagement members 20*a,* 20*b* are preferably spaced from each other a selected distance, D, and may preferably be aligned with respect to each other. The distance between the engagement members is a function of the width, W, of board 12, as measured just above and/or below the waist of the board. Thus, a pair of engagement members may preferably be spaced so that the distance between the engagement members is larger than the size of the waist of the board, yet smaller than the maximum width of the board so that the waist of the board can be inserted between the engagement members and the sides of a particular size board can be gripped by the engagement members above and below the waist of the board. To accommodate various size boards, the rack 10 may include a plurality of paired, stepped engagement members 20*a,* 20*b* as shown in FIG. 3. For each engagement member 20*a* formed in side wall 16 there preferably is a corresponding engagement member 20*b* formed in sidewall 18. The distance between opposing engagement members is preferably chosen to accommodate a particular size board. Thus, the distances ($D_1$, $D_2$, $D_3$, etc.) between each pair of engagement members 20*a,* 20*b* may increase in a direction away from the base 14 of the rack 10 to hold boards with increasingly larger widths. In the present embodiment, the rack may include seven pairs of stepped engagement members with the distance between the first pair of engagement members ($D_1$) being about 7.5 inches, and the distance between the seventh pair of engagement members ($D_7$) being about 10.75 inches. The distances between the remaining pairs of engagement members ($D_2$–$D_6$) range between about 7.5 to 10.75 inches, to accommodate snowboards sized within the range. At least one pair of engagement members is provided on rack 10, but the rack may contain as many pairs of engagement members as desired, corresponding to the various size boards designed to fit within the rack. In the present embodiment, rack 10 preferably includes seven pairs of stepped engagement members which are offset from each other to engage boards ranging in maximum width from about 185 millimeters to about 272 millimeters, snowboards of this size being available from the Burton Corporation of Burlington, Vt.

Figure 4:
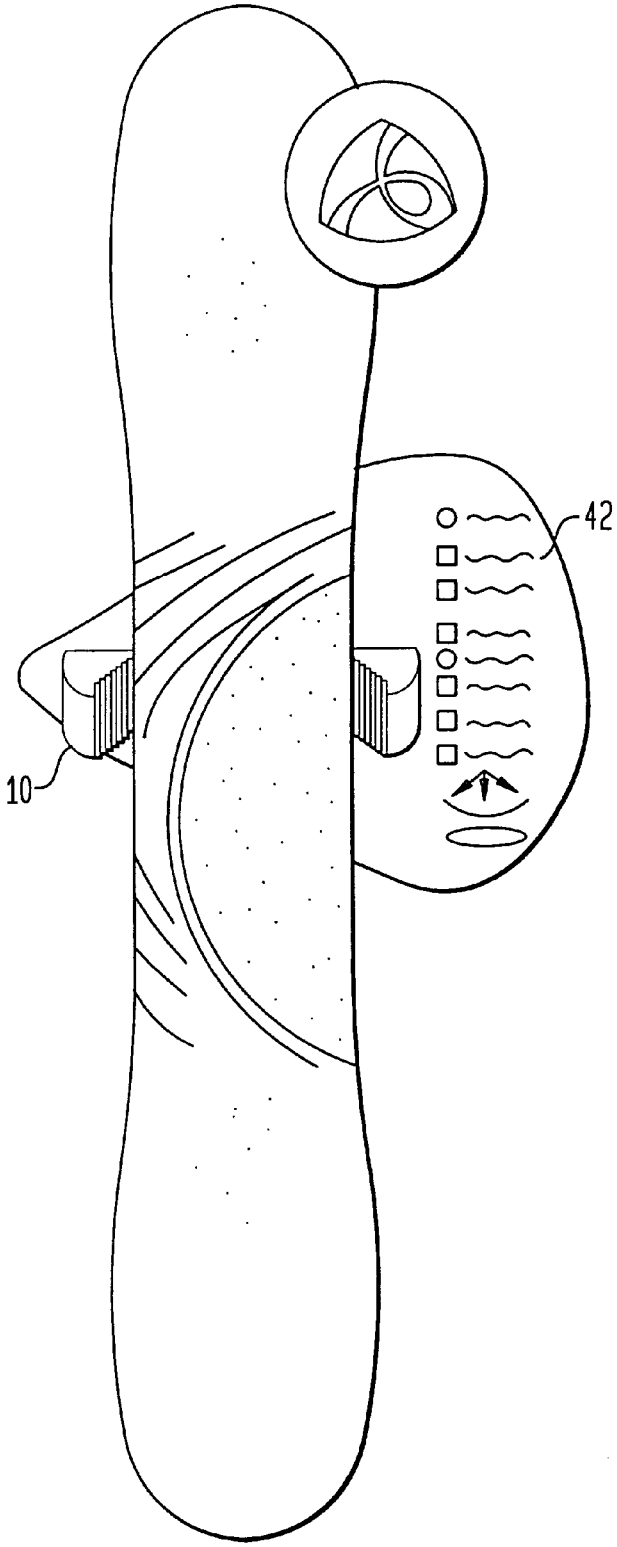
FIG. 4 is a front view of the rack of FIG. 1 mounted to a display sign.

Rack 10 is preferably mounted to a support surface, such as a wall, by screws disposed through apertures 38, 40 in the base 14. Alternately, the rack may be mounted to the support surface in any suitable manner, for example hangers, Velcro and the like as would be known to one of skill in the art. When used to display a snowboard, such as at a trade show, the rack may additionally be mounted to a display sign 42, as shown in FIG. 4. Such a display sign may be any shape or color and may be made of metal or other materials. The sign 42 may contain information relating to the board displayed, or alternately, may contain other types of information, for example, information relating to the manufacturer of the board. In the embodiment of FIG. 4, display sign 42 is in the shape of a guitar pick, is constructed of metal, and contains graphics as well as written information relating to the manufacturer of the board. Because the engagement members 20*a,* 20*b,* only slightly overlap the face of the snowboard, the graphics on the board are readily visible and not interrupted, as shown in FIG. 4.

In use, rack 10 is mounted to a support a surface such as a wall in a desired orientation such as upright, horizontal or at any angle between vertical and horizontal. If mounted vertically, a user aligns the longitudinal axis, y, of the snowboard with the rack, inserts the waist of the board between engagement members 20*a,* 20*b,* corresponding to the particular size of the board, and slides or lowers the board in a downward direction, A, until the engagement members grip the sides of the board, as described above. When mounted horizontally, a user aligns the longitudinal axis, y, of the snowboard with the rack, inserts the waist of the board between engagement members 20*a,* 20*b,* corresponding to the particular size of the board, and slides the board in a sideways direction until the engagement members grip the sides of the board, as described above. When the rack is mounted in a titled orientation, the user would likewise insert the waist of the board between the engagement members and move the board until the engagement members grip the sides of the board, as described above. To remove the board from the rack, the user simple slides the snowboard until the waist of the board is adjacent the engagement members, at which point the width of the board is narrowest, such that the board can readily be lifted from between the engagement members. Rack 10 is intended to hold a single board at a time but may, alternately, hold any number of boards provided the rack is provided with appropriately spaced engagement members. If used to hold multiple boards, the narrowest board may preferably be positioned furthest back on the rack, i.e. closest to the base of the rack, and the rack may be reinforced to carry the heavier load. The rack of the present invention can be used to securely hold various size snowboards without requiring adjustment of the rack, without damaging the top, bottom and side edges of the snowboard, and without interrupting the graphics on the board when displayed. The rack can also hold several boards simultaneously and permits easy removal of the snowboards.

It will be understood that various modifications may be made to the embodiment disclosed herein. For example, the rack may include multiple engagement members spaced to hold the same size snowboard instead of snowboards of varying sizes or the rack may be designed to hold a single snowboard. In addition, although described for use with a snowboard, the rack may be utilized with other gliding boards, such as skis, skateboards and the like. Therefore, the above description should not be construed as limiting, but merely as exemplifying a preferred embodiment. Those skilled in the art will envision other modifications within the scope spirit of the invention.

What is claimed is:

1. A rack for holding a gliding board having a pair of side edges and an upper and lower surface, the rack comprising:

a base; and a first engagement member cooperating with said base and a second engagement member cooperating with said base and spaced from said first engagement member, at least one of said first and second engagement members including a plurality of engagement steps that taper outwardly relative to said base, each engagement step including a shoulder defined by a side surface and a rear surface, said side surface being configured and arranged to engage a portion of the side edges of the gliding board, said rear surface being configured and arranged to engage a portion of one of the upper and lower surfaces of the gliding board, wherein said rack grips and holds the gliding board between said first and second engagement members.

2. The rack of claim 1, wherein said base, said first engagement member and said second engagement member are formed as a unitary piece.

3. The rack of claim 1, wherein said first and second engagement members are constructed of a resilient material.

4. The rack of claim 3, wherein the resilient material is rubber.

5. The rack of claim 1, wherein the base has a base surface that is to extend substantially parallel to a support surface when the rack is connected to the support surface, wherein said first engagement member and said second engagement member are aligned with respect to each other along an axis parallel to the base surface.

6. The rack of claim 1, wherein said side surface is disposed at an acute angle relative to an axis parallel to the rear surface.

7. The rack of claim 1, wherein each engagement member comprises a plurality of engagement steps that taper outwardly from said base.

8. The rack of claim 1, wherein the rack is mounted to a display sign.

9. The rack of claim 1, wherein a distance between a side surface of one engagement step on one engagement member and the other engagement member is configured and arranged to be greater than the width of the board at a waist, wherein the board has a tip end, a tail end, and a waist disposed between the tip and tail ends and said width of said board varies along the length of said board with said width being smallest at said waist and larger at said tip and tail ends, and less than the widths of the board at the tip and tail ends.

10. An apparatus comprising:

a snowboard having a pair of side edges and an upper and lower surface; and a rack for holding said snowboard, said rack comprising:

a base; and a pair of engagement members holding said snowboard therebetween, said pair of engagement members having a first engagement member extending from said base and a second engagement member extending from said base and spaced from said first engagement member, at least one of said first and second engagement members including a plurality of engagement steps that taper outwardly from said base, each engagement step including a shoulder defined by a side surface and a rear surface, said side surface engaging a portion of one of said side edges of said snowboard and said rear surface engaging a portion of one of said upper and lower surfaces of said snowboard.

11. The apparatus of claim 10, wherein the board includes a graphic design on at least one surface thereof and wherein the rack does not interfere with viewing of the graphic design when the board is held in the rack.

12. The apparatus of claim 10, wherein said pair of engagement members are non-adjustable.

13. The apparatus of claim 12, wherein a distance between a side surface of one engagement step on one engagement member and the other engagement member is approximately 7.5 inches.

14. The apparatus of claim 10, wherein each of said first and second engagement members includes a plurality of engagement steps that taper outwardly from said base.

15. The apparatus of claim 10, wherein said side surface is disposed at an acute angle relative to said rear surface.

16. The apparatus of claim 10, wherein said base, said first engagement member and said second engagement member are formed together as a unitary piece.

17. The apparatus of claim 10, wherein said snowboard further includes a tip end, a tail end, and a waist disposed between said tip end, said board having a varying width that is smallest at said waist and larger at said tip end, wherein a distance between a side surface of one engagement step on one engagement member and the other engagement member is greater than said width of said board at said waist and less than said width of said board at said tip end or tail end.

18. A rack for holding a gliding board having a pair of side edges and an upper and lower surface, the rack comprising:

a base for connecting the rack to a support surface; and a first set of at least three engagement steps extending from said base and a second set of at least three engagement steps extending from said base opposing said first set of at least three engagement steps to define first, second and third opposing engagement steps, each of said opposing engagement steps including opposing side surfaces configured and arranged to engage a portion of the side edges of the gliding board, and rear surfaces configured and arranged to engage a portion of one of the upper and lower surfaces of the gliding board, wherein said rack grips and holds the gliding board between opposing engagement steps;

wherein opposing side surfaces of said first, second and third opposing engagement steps are separated by respective first, second and third distances, wherein each distance is different than the other distances, said rack thereby accommodating boards of different sizes.

19. The rack of claim 18, wherein said third opposing engagement steps extend further from said base than said first opposing engagement steps.

20. The rack of claim 19, wherein said third distance is greater than said second distance, which is greater than said first distance.

21. The rack of claim 18, wherein said side surfaces are disposed at an acute angle relative to said rear surfaces.

22. The rack of claim 18, wherein one of said first, second and third distances is configured and arranged to be greater than the width of the board at a waist, wherein the board has a tip end, a tail end, and a waist disposed between the tip and tail ends and said width of said board varies along the length of said board with said width being smallest at said waist and larger at said tip and tail ends, and less than the widths of the board at the tip and tail ends.

23. The rack of claim 18, wherein each of said first and second sets of engagement steps is non-adjustable.

24. A rack for holding a gliding board having a pair of side edges and an upper and lower surface, said rack comprising:

a base; and a plurality of first engagement steps disposed on said base and a plurality of second engagement steps disposed on said base opposite said plurality of first engagement steps, said plurality of first engagement steps including a first outermost step relative to said base and a first innermost step relative to said base and said plurality of second engagement steps including a second outermost step relative to said base and a second innermost step relative to said base, said outermost steps being separated by a distance that is greater than a distance separating said innermost steps each engagement step including a shoulder defined by a side surface and a rear surface, said rear surface being configured and arranged to engage a portion of one of the upper and lower surfaces of the gliding board, said side surface being configured and arranged to engage a portion of one of the side edges of the gliding board, wherein said rack grips and holds the gliding board between a step of said plurality of first engagement steps and an opposing step of said plurality of second engagement steps.

25. The rack of claim 24, wherein said side surface is disposed at an acute angle relative to said rear surface.

26. The rack of claim 24, wherein said base, said plurality of first engagement steps and said plurality of second engagement steps are formed together as a unitary piece.

27. The rack of claim 24, wherein said plurality of engagement steps are constructed of a resilient material.

28. The rack of claim 27, wherein said resilient material is rubber.

29. The rack of claim 24, wherein an engagement step of said plurality of first engagement steps and an opposing engagement step of said plurality of second engagement steps are separated by a distance of approximately 7.5 inches.

30. The rack of claim 24, wherein said side surface has a length of approximately 0.5 inches.

31. The rack of claim 24, wherein said rear surface has a width of approximately 0.4 inches.

32. A rack for holding a gliding board having a pair of side edges, said rack comprising:

a base; and a first engagement member cooperating with said base and an opposed second engagement member cooperating with said base and spaced from said first engagement member, said first engagement member having at least a first step, a second step and a third step and said second engagement member having at least a corresponding first step, a corresponding second step and a corresponding third step, wherein said first, second and third steps of said first engagement member and the corresponding first, second, and third steps of said second engagement member are separated by respective first, second and third distances, wherein each distance is different than the other distances, with a step on said first engagement member cooperating with a corresponding step on said second engagement member to hold the side edges of the gliding board therebetween.

33. The rack of claim 32, wherein said base and said first and second engagement members are formed together as a unitary piece.

34. The rack of claim 32, wherein each of said steps includes a side surface and a rear surface, with said side surface being disposed at an acute angle relative to said rear surface.

35. The rack of claim 32, wherein said distance separating any one of said step and corresponding step is approximately 7.5 inches.

36. The rack of claim 32, wherein at least one of said engagement members tapers outwardly from said base.

* * * * *